United States Patent [19]

Knight

[11] Patent Number: 4,583,735

[45] Date of Patent: Apr. 22, 1986

[54] GOLF GAME APPARATUS

[76] Inventor: Donald L. Knight, 1720 Ala Moana, Apt. H204, Honolulu, Hi. 96815

[21] Appl. No.: 706,938

[22] Filed: Feb. 28, 1985

[51] Int. Cl.[4] ..... A63F 7/06

[52] U.S. Cl. ..... 273/87.4

[58] Field of Search ..... 273/87.2, 87.4, 245, 273/259, 277

[56] References Cited

U.S. PATENT DOCUMENTS

| | | | |
|---|---|---|---|
| 1,391,306 | 9/1921 | Eliaser | 273/87.4 |
| 1,482,330 | 1/1924 | Treboul | 273/245 |
| 1,553,027 | 9/1925 | Brown | 273/87.2 |
| 1,735,794 | 11/1929 | Ristow | 273/245 |
| 1,741,224 | 12/1929 | Clark | 273/245 X |
| 3,050,307 | 8/1962 | Glass et al. | 273/87 H |
| 3,771,792 | 11/1973 | Crumlish | 273/245 |
| 4,113,260 | 9/1978 | Sain | 273/245 |
| 4,127,273 | 11/1978 | Bonvetti | 273/245 |

FOREIGN PATENT DOCUMENTS

| | | | |
|---|---|---|---|
| 1136652 | 12/1968 | United Kingdom | 273/87.2 |

*Primary Examiner*—George J. Marlo

*Attorney, Agent, or Firm*—Norman B. Rainer

[57] ABSTRACT

A game is provided which simulates the game of golf as played on an outdoor golf course. Successful playing of the game is dependent upon the player's ability to skillfully propel a playing ball into desired compartments in a playing apparatus. The compartments surround the interior of a circular enclosure having a floor and a circular inner disc centered within the enclosure and pivotably mounted to the floor. The playing ball is positioned upon the inner disc and struck by swinging movement of an elongated striking bar, thereby propelling the ball into a compartment. The rules of the game are essentially the same as the rules for the outdoor game of golf.

6 Claims, 4 Drawing Figures

GOLF GAME APPARATUS

BACKGROUND OF THE INVENTION

This invention relates to a game which simulates the game of golf as played on an outdoor golf course, and is particularly concerned with board-type game apparatus wherein success in the playing of the game is enhanced by the player's ability to skillfully employ manipulative means.

Numerous board-type golf games are known comprising a playing board depicting a golf course, marking elements for placement upon the board by each player, and chance means such as dice, a spinner, or a stack of cards which determine movement of the marking elements. Typical specific embodiments of such chance-controlled games are described in U.S. Pat. Nos. 4,127,273; 4,113,260; 3,771,792; 1,482,330; 1,741,224; and 1,735,794. Although such games are entertaining, there is an absence of the challenge of performance of personal skills susceptible to improvement with practice, as in the case of the actual game of golf as played on an outdoor golf course.

Most prior board-type golf games are further restricted to the use of only one specific golf course layout on a playing board. In such instances, interest in the game can rapidly wane.

It is accordingly an object of the present invention to provide a golf game apparatus involving manipulative means whose operation requires skills which can be improved with repetitious effort.

It is another object of this invention to provide a golf game apparatus as set forth in the foregoing object having the capability of simulating more than one specific golf course layout.

It is a further object of the present invention to provide a golf game apparatus of the aforesaid nature wherein said manipulative means involves the striking of a ball in a manner simulating the outdoor game of golf.

These objects and other objects and advantages of the invention will be apparent from the following description.

SUMMARY OF THE INVENTION

The above and other beneficial objects and advantages are accomplished in accordance with the present invention by a game apparatus comprising in combination:

(a) selection means comprising:

1. an enclosure comprised of a floor and circular sidewall rising upwardly from said floor,
2. a circular inner disc positioned upon said floor and rotatively mounted thereto by pivot means centered with respect to said inner disc and sidewall,
3. a stationary outer panel surrounding said inner disc and substantially coplanar therewith, said outer panel being defined by concentric inner and outer circular peripheries, the inner periphery of said outer panel being in close-fitting adjacency to the outer perimeter of said inner disc,
4. a series of depressed compartments positioned between the outer periphery of said outer panel and said sidewall, each compartment having associated therewith printed indicia representing game instructions, 5. striking means pivotably mounted to said inner disc.
6. a ball having a size adapted to be propelled by said striking means into said compartments, and
7. a depression in said inner disc adapted to position said ball before said striking means, (b) a series of playing boards, each having indicia representing the (c) score cards associated with each playing board, and (d) position markers for use by the players upon a playing board to denote status of the game.

In preferred embodiments, the outer panel has a slight downward slope in the radial direction going from its inner to outer peripheries, and contains printed indicia constituting playing instructions adapted to dictate the positioning of the inner disc. The inner disc may be rotated by manipulation of the striking means, but specific rotating means may be provided to properly orient the inner disc and hold it in position during manipulation of the striking means. The striking means may be provided with the upright figure of a golfer with a golf club positioned in a manner such that the head of the club makes contact with the aforesaid game ball. The rules and instructions governing the playing of the game are substantially the same as the outdoor game of golf played on a golf course.

BRIEF DESCRIPTION OF THE DRAWING

For a fuller understanding of the nature and objects of the invention reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
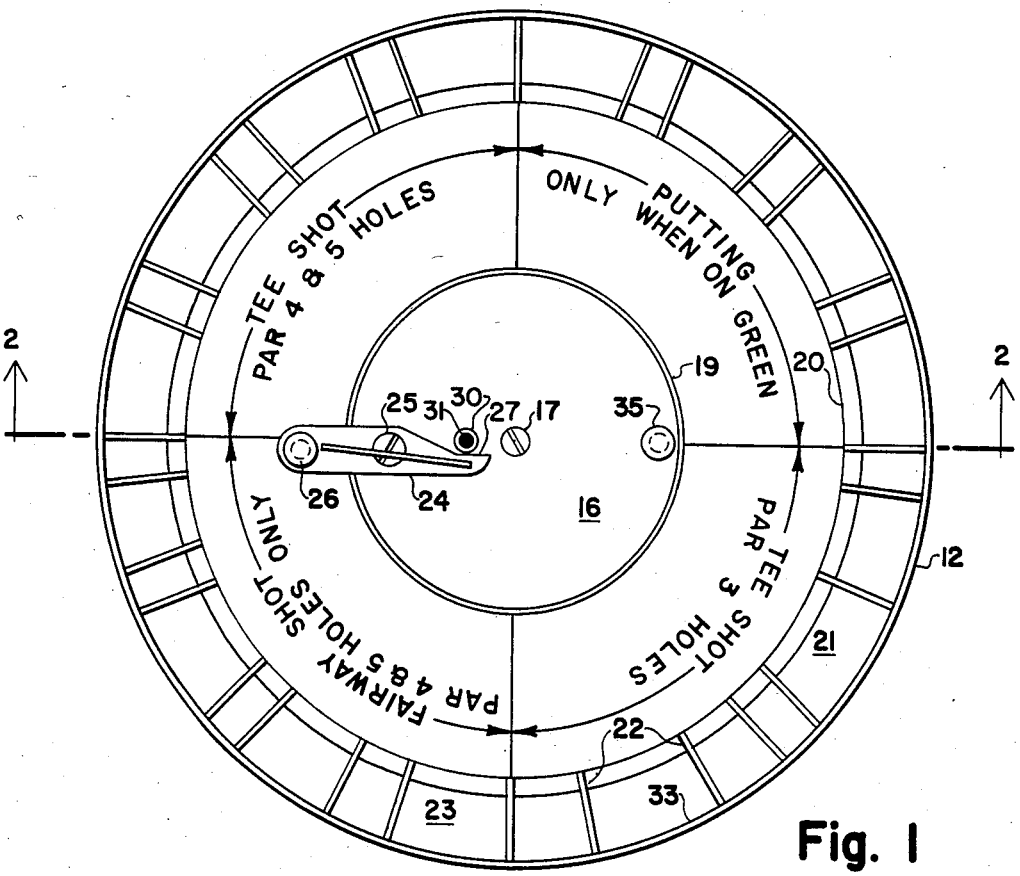
FIG. 1 is a top plan view of an embodiment of selection means of the game apparatus of this invention.
Figure 2:
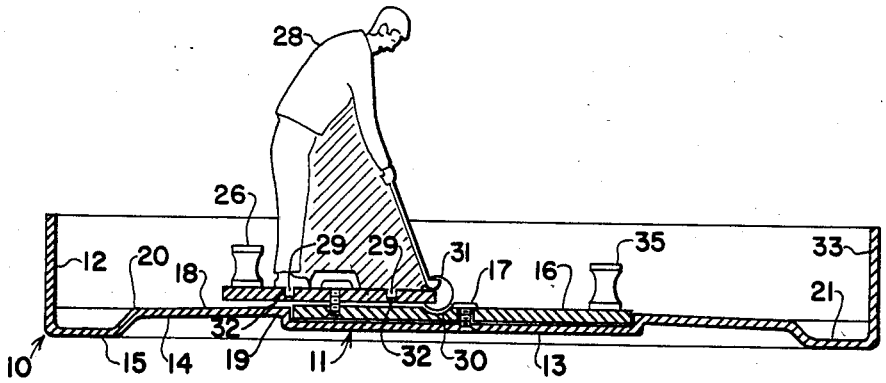
FIG. 2 is a sectional side view taken along the line 2—2 of FIG. 1.

Referring to FIGS. 1 and 2, an embodiment of the selection means component of the apparatus of this invention is shown comprised of enclosure 10 defined by floor panel 11 and circular sidewall 12 rising upwardly from the floor panel. The enclosure of the illustrated embodiment is of integral monolithic construction amenable to fabrication from thermoplastic or metal materials by molding techniques or thermoforming from sheet stock. Alternatively, the enclosure may be fabricated by installing a circular sidewall upon a separate floor panel. The floor is comprised of center platform 13 of circular configuration, first surrounding portion 14, and second surrounding portion 15.

A flat disc-like member 16, hereinafter to be referred to as the inner disc, is positioned above center platform 13 and rotatively mounted thereto by pivot post 17 centered with respect to said inner disc and sidewall.

The upper surface 18 of first surrounding portion 14, hereinafter to be referred to as the outer panel, is bounded by concentric inner and outer circular peripheries, 19 and 20, respectively. Said outer panel is downwardly sloped at an angle of 2° in the direction of sidewall 12 and contains printed indicia dividing the surface into four equal radial quadrants, each having indicia specifying game conditions such as:

quadrant 1: Tee shot—Par 4 & 5 Holes
quadrant 2: Tee shot—Par 3 Holes
quadrant 3: Fairway shot—Par 4 & 5 Holes
quadrant 4: Putting Contiguous to outer periphery 20 is depressed annular trough 21 constituting the upper surface of second surrounding portion 15 of the floor panel. Said trough surrounds outer panel 18, and is bounded by outer circular periphery 20 and sidewall 12. A series of radially disposed and variably spaced divider strips 22 are positioned in upright disposition within trough 21, thereby forming compartments 23 of different sizes. The divider strips may be separate pieces inserted into floor panel 11, or may be integral with the enclosure. By virtue of the illustrated construction, it is seen that the compartments lie below the outer periphery 20 of outer panel 18.

Striking means in the form of elongated bar 24 is rotatably mounted to inner disc 16 by pivot post 25 located adjacent the outer circular perimeter of said disc. An upright rotatable post 26 is positioned atop one extremity of bar 24. Post 26 is struck by a finger to rotate bar 24 to produce a striking action. The opposite extremity of bar 24 is provided with indented striking surface 27. A rigid panel 28 having the appearance of a golf player with club in striking position is removably associated with the upper surface of bar 24. Said removable association is achieved in the illustrated embodiment by virtue of pegs 29 in the bottom of panel 28 that engage holes 32 in the uppermost surface of bar 24. Such removable association is for the purpose of facilitating flat packaging of the game apparatus for shipping and storage purposes. Other removable association means may be employed, such as a slide and track mechanism, magnetic strips, Velcro binders, and the like.

A depression 30 is located in inner disc 16 at a site adjacent pivot post 17 and substantially on a radius that includes pivot post 25 of striking bar 24. Said depression is designed to position a playing ball 31 having a diameter of about $\frac{1}{4}''$ and adapted to fit within compartments 23.

Printed indicia is located upon the interiorly directed face 33 of sidewall 12 in association with each compartment, the following indicia being exemplary:

adjacent quadrant 1:
1. Trap—Place marker on fairway shooting 3.
2. Fairway.
3. Topped drive. Shooting 2 off tee.
4. Fairway.
5. Out of bounds shooting 3 off tee.
6. Fairway.
7. Rough—Place marker on fairway shooting 3.

adjacent to quadrant 2:
1. Holed out from sand.
2. On green in one.
3. Trap on green in 2.
4. Hole in one.
5. Trap on green in 3.
6. On green in one.
7. Over green on green in 2.

adjacent to quadrant 3:
1. Sand trap on green in 3.
2. On green.
3. Out of bounds on green in 4.
4. On green.
5. Short of green - in 3.
6. On green.
7. Trap on green in 4.
8. Holed out.

adjacent to quadrant 4:
1. 3 putts.
2. One putt.
3. 2 putts.
4. One putt.
5. 3 putts.
6. One putt.
7. 2 putts.

The arrangements of the printed indicia upon the sidewall is such that the more difficult accomplishments are associated with compartments or narrower width. For example, the one putt compartment is narrower than the 2 putt compartment which, in turn, is narrower than the 3 putt compartment.

Figure 3:
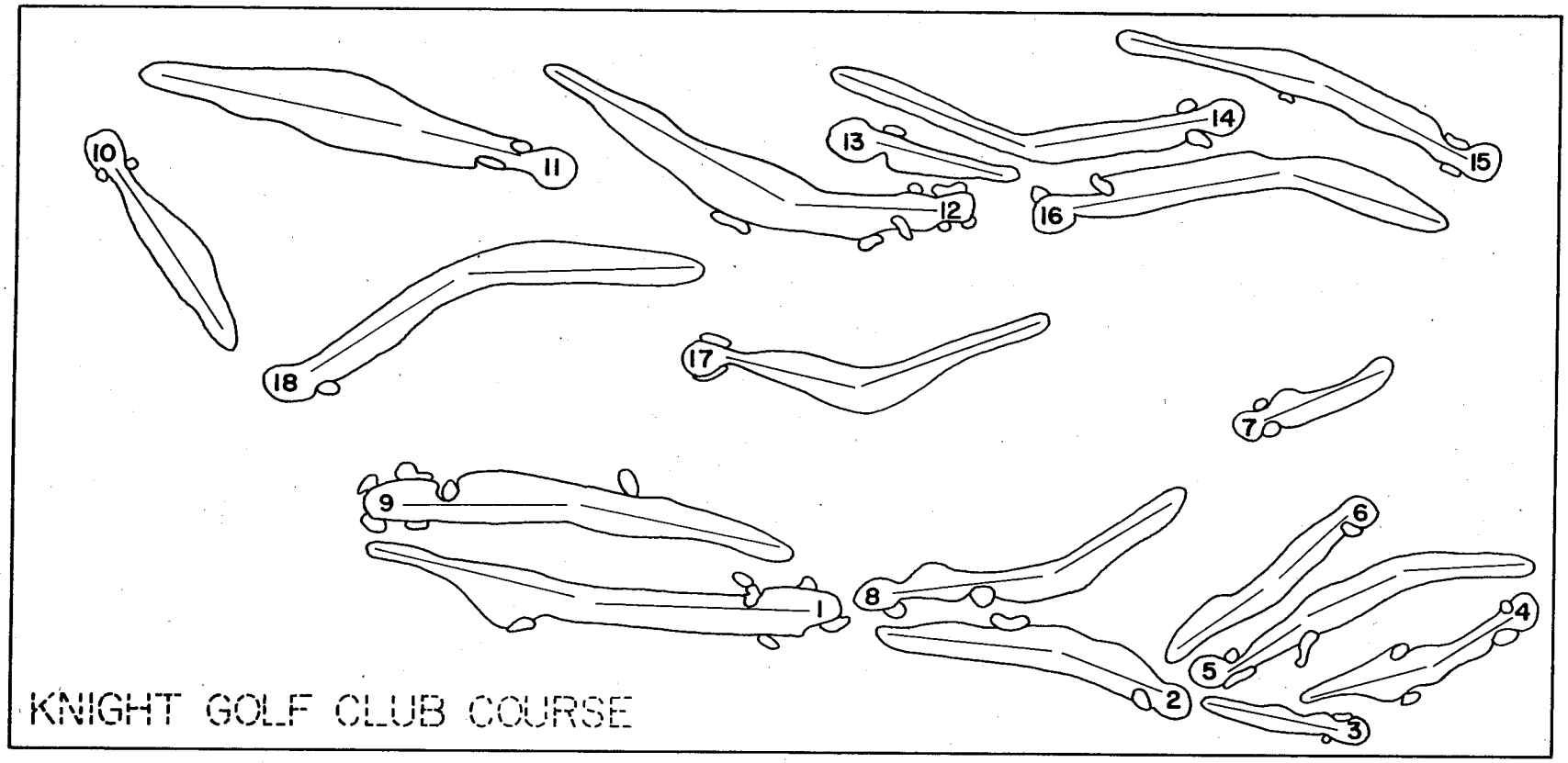
FIG. 3 is a top plan view of a playing board constituting a component of the game apparatus combination of this invention.
Figure 4:
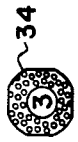
FIG. 4 is a perspective view of a position marker constituting a component of the game apparatus combination of this invention.

In playing the game, each player in turn rotates the inner disc to the appropriate quadrant of the outer panel and carefully aligns depression 30 with the ball emplaced therein to be in line with a desired compartment. The ball is then struck by swinging movement of bar 24. Based upon the compartment into which the ball actually falls, the player will appropriately place his marker 34 upon the playing board shown in FIG. 3. As shown in FIG. 4, the marker is provided with numbered facets adapted to indicate stroke counts. The marker may otherwise have the appearance of a golf ball. The progress of a player in playing the game will depend upon his ability to strike the ball into the more desirable components.

The illustrated playing board, which is one of several included within the game apparatus, contains printed indicia designating in multiple colors the various features of a golf course such as: fairways, numbered putting greens, sand traps, water obstacles, and wooded areas. The boards preferably describe various actual golf courses of world renown.

The general scoring and sequence of events are the same as in the outdoor game of golf as played on a golf course. Most shots possible on a regular outdoor golf course can be duplicated while playing the gaae of the present invention. For example, double eagle, eagle, birdie and par on par 5 holes; eagle-birdie and par on par 4 holes; and hole in one, birdie and par on par 3 holes. Also present are conditions that could lead to bogie-double bogie, and other status conditions. Score cards are provided as part of the game apparatus.

While particular examples of the current invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A golf game apparatus comprising in combination:
(a) selection means comprising:
1. an enclosure comprised of a floor and circular sidewall rising upwardly from said floor,
2. a circular inner disc positioned upon said floor and rotatively mounted thereto by pivot means centered with respect to said inner disc and sidewall, 3. a stationary outer panel surrounding said inner disc and substantially coplanar therewith, said outer panel being defined by concentric inner and outer circular peripheries, the inner periphery of said outer panel being in close-fitting adjacency to the outer perimeter of said inner disc, 4. a series of depressed compartments positioned between the outer periphery of said outer panel and said sidewall, each compartment having associated therewith printed indicia representing game instructions, 5. striking means pivotably mounted to said inner disc.

6. a ball having a size adapted to be propelled by said striking means into said compartments, and 7. a depression in said inner disc adapted to position said ball before said striking means, (b) a series of playing boards, each having indicia representing the features of outdoor golf courses, (c) score cards associated with each playing board, and (d) position markers for use by the players upon a playing board to denote status of the game.

2. The golf game of claim 1 wherein the outer panel has a slight downward slope going radially from its inner to outer peripheries.

3. The golf game of claim 2 wherein said outer panel contains printed indicia constituting playing instructions adapted to dictate the positioning of the inner disc.

4. The golf game of claim 3 wherein said striking means is provided with the upright figure of a golfer with a golf club positioned in a manner such that the head of the club makes contact with said game ball.

5. The golf game of claim 3 wherein the game instructions associated with said depressed compartments is in the form of printed indicia on the interiorly directed face of said sidewall.

6. The golf game of claim 3 wherein said position markers contain numerical indicia corresponding to a number of golf strokes.

* * * * *